US006098944A

United States Patent [19]

Pangborn et al.

[11] Patent Number: 6,098,944

[45] Date of Patent: Aug. 8, 2000

[54] HOLDER FOR SUPPORTING A COMPONENT BELOW A SUPPORT

[75] Inventors: Donald R. Pangborn, Jamestown; Richard L. Watt, Bemus Point; James R. Caronia, Jamestown, all of N.Y.

[73] Assignee: Weber Knapp Company, Jamestown, N.Y.

[21] Appl. No.: 09/305,542

[22] Filed: May 5, 1999

[51] Int. Cl.[7] ..... A47H 1/10

[52] U.S. Cl. ..... 248/317; 248/316.1; 248/499; 248/505

[58] Field of Search ..... 248/316.1, 317, 248/320, 325, 326, 327, 328, 329, 332, 323, 648, 674, 675, 680, 589, 500, 499, 525; 254/294, 310, 376

[56] References Cited

U.S. PATENT DOCUMENTS

| | | | |
|---|---|---|---|
| D. 306,239 | 2/1990 | Watt | D6/430 |
| 3,822,049 | 7/1974 | Saunders | 248/203 |
| 4,101,109 | 7/1978 | Edwards | 248/317 |
| 5,131,620 | 7/1992 | Boundy | 248/674 |
| 5,393,025 | 2/1995 | Franklin | 248/317 |
| 5,927,668 | 7/1999 | Cyrell | 248/317 |

OTHER PUBLICATIONS

Weber Knapp Company 18484 Instruction Sheet for 18475 CPU Holder and 18785 CPU Holder w/Swivel.

*Primary Examiner*—Anita M. King
*Assistant Examiner*—Gwendolyn Baxter
*Attorney, Agent, or Firm*—Simpson, Simpson & Snyder

[57] ABSTRACT

A mechanism for supporting a component, such as a CPU, below a support, includes a support member mounted to depend from the support and being adapted to undergo both horizontally directed sliding movement and pivotal movement about a vertically disposed pivot axis relative thereto, a pair of straps having first and second ends, and a strap tension adjustment device carried by the support member, wherein second ends of the straps are removably fixed to the support member and first ends of the straps are fixed to the tension adjustment device, such that the straps are suspended below the support member as U-shaped loops sized to receive the component therewithin, and the tension adjustment device is manually operable to releasably shorten the lengths of the loops for clamping the component in position relative the support member. The component may be selectively mounted such that its major side surfaces or panels are arranged either normal or parallel to a lower surface of the support.

16 Claims, 5 Drawing Sheets

HOLDER FOR SUPPORTING A COMPONENT BELOW A SUPPORT

BACKGROUND OF THE INVENTION

In prior U.S. Pat. No. 5,131,620, there is disclosed a mechanism for mounting a component, such as a CPU, below a support, such as the work surface of a desk or work station, which employs a support member fixed to depend from the support and a pair of straps for clamping the component upwardly against the support member. The support member is supported by a tradeway for horizontal sliding movement.

A somewhat similar mechanism has been sold commercially for several years by the assignee of the present application. In this prior mechanism, the support member is connected to a carriage for pivot movement about a vertically disposed axis and the carriage is slidably supported for horizontal movement by a trackway.

A drawback of the known mechanisms mentioned above is that they require the use of snap buckles to join ends of the strap, and the threading of the straps through such buckles for adjustment/component clamping purposes. Further, such mechanisms are restricted in design for use in supporting components of rectangular cross-sectional configuration, and more particularly, components of rectangular cross-section configuration with their major side surfaces or panels arranged to extend normal to the support.

SUMMARY OF THE INVENTION

The present invention relates to a mechanism for use in mounting a component, such as a CPU, to removably depend from a support.

More particularly, the present mechanism generally includes a support member mounted to depend from a support, a pair of straps each having first and second ends, and a tension adjustment device mounted on the support member and engaging with the first ends of the straps, with second ends of the straps being removably attached directly to the support member, whereby the straps are suspended below the support member as U-shaped loops sized to receive the component therewithin, and the tension adjustment device is manually operable to releasably shorten the lengths of the loops for clamping the component upwardly against the support member.

More specifically, the support member is in the form of a generally rectangular, horizontally disposed support plate having elongated, parallel, depending side portions and parallel, depending end portions, wherein the end portions cooperate to support the tension adjustment device and the side portions define pairs of mounting surfaces depending below the end portions and arranged for engagement with the component when clamped upwardly against the support member. The end portions are preferably formed with downwardly facing concave free edges accommodating for free receipt of convex side surfaces or panels of a component when engaged with the mounting surfaces.

Further, it is preferable to fix the first ends of the straps to a rod having opposite ends rotatably supported within bore openings defined by the end portions, a toothed wheel fixed for rotation with the rod, a ratchet arm pivotally supported by the support plate for releasable engagement with a toothed wheel, and a manually operating handle for releasable engagement with the rod for purposes of manual tensioning of the straps and adapted to be releasably stored on the support plate adjacent the tension adjustment device.

The present mechanism may be modified to permit mounting of a component such that its major side surfaces are horizontally disposed. In this arrangement, pairs of mounting clips are adapted to releasably engage with the side portions of the support plate and provided with through slide mounting openings for removable, sliding receiving adjacent end portions of pairs of oppositely extending tubes having strap guiding end caps mounting on their oppositely facing ends. The end caps engage with portions of the loops relatively adjacent their first and second ends and additionally define bearing surfaces of the component engaging when the loop is shortened by the tension adjustment device.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
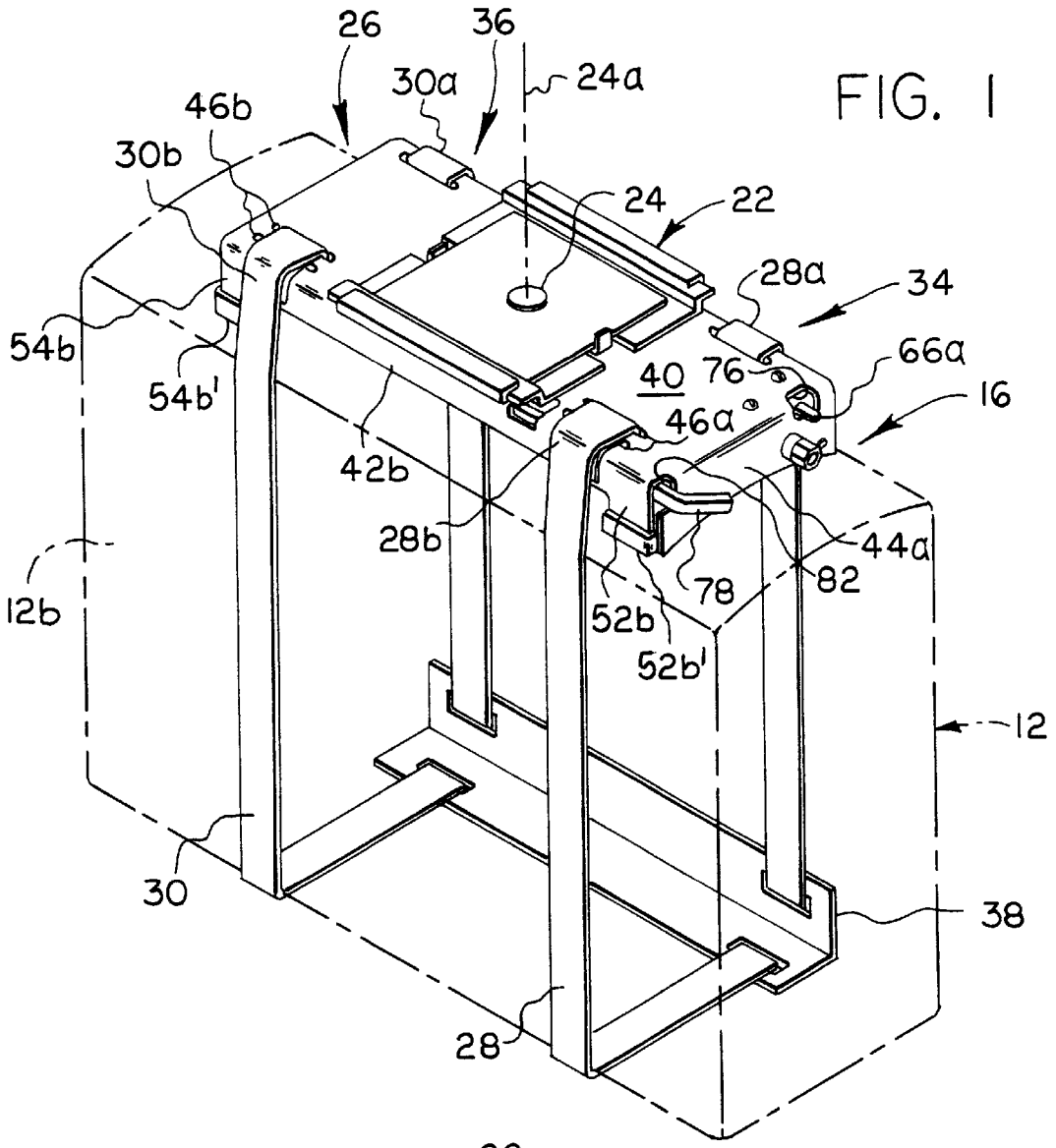
FIG. 1 is a prospective view of a holder formed in accordance with the present invention.

Reference is first made to FIGS. 1–4, wherein a holder or support mechanism formed in accordance with a preferred form of the present invention is generally designated as 10 and shown as serving to removably suspend or support a component 12, such as a CPU, beneath a support 14, such as a top of a table, desk, or work station having vertically facing and generally horizontally disposed upper and lower surfaces 14*a* and 14*b*, respectively.

Holder 10 generally includes a component clamping means generally designated as 16 and suitable mounting means 18, which is intended to be attached to support 14 and serves to suspend the component clamping means beneath the support in a position in which the component 12 is accessible to a user thereof.

Mounting means 18 may be variously defined, but preferably includes a guide track 20 fixed, as by fasteners, not shown, to support lower surface 14*b*, and a trolley 22, which is supported by the track way for horizontal sliding movement and includes a suitable pivot device 24 serving to support clamping means 16 for pivotal movement about a vertically extending pivot axis 24*a* arranged normal to surface 14*b*. Mounting means 18 is shown by way of example as being of the type disclosed in U.S. Design Pat.

No. 306,239 for use in adjustably mounting a keyboard beneath a work surface. Alternatively, if desired, component clamping means 16 may be non-movably fixed to depend from surface 14*b*.

Component clamping means 16 is shown in FIGS. 1–4 as including a support member 26 coupled to trolley 22 by pivot device 24; a pair of flexible straps 28 and 30 having first and second ends 28*a*, 30*a* and 28*b*, 30*b*, respectively; a strap tension adjustment mechanism 32; and attaching means 34 and 36 cooperating with the strap tension adjustment mechanism to suspend the straps a s U-shaped loops beneath the support member. If desired, the mid-portions of straps 28 and 30 may be threaded through one or more rigid spacer braces 38 tending to maintain such mid-portion spaced apart through a distance corresponding essentially to the spacing between strap first ends 28*a*, 30*a* and second ends 28*b*, 30*b*.

Support member 26 includes a support plate 40, which is coupled to trolley 22 and arranged to assume a generally horizontally disposed position beneath support 14 and provided with depending first and second parallel edge portions 42*a* and 42*b* and first and second parallel end portions 44*a* and 44*b* disposed normal to the edge portions. In the illustrated form of the invention, support plate 40 is provided with two pairs of parallel slots 46*a*, 46*a* and 46*b*, 46*b* to define attaching means 34 and 36 for use in releasably threadably receiving strap second ends 28*b* and 30*b*; a pair of slots 48*a*, 48*b* to permit strap first ends 28*a* and 30*a* to be passed upwardly therethrough; and a depending retaining tongue 50 whose purpose will hereinafter be described. It is now contemplated that the original structure of the attaching means may be exchanged by replacing slots 46*a*, 46*a* and 46*b*, 46*b* with a pair of T-shaped slot openings, which are individually sized to removably mount a T-shaped mounting clip having a pair of parallel slot s th rough which a second end of a strap may be threaded.

Figure 2:
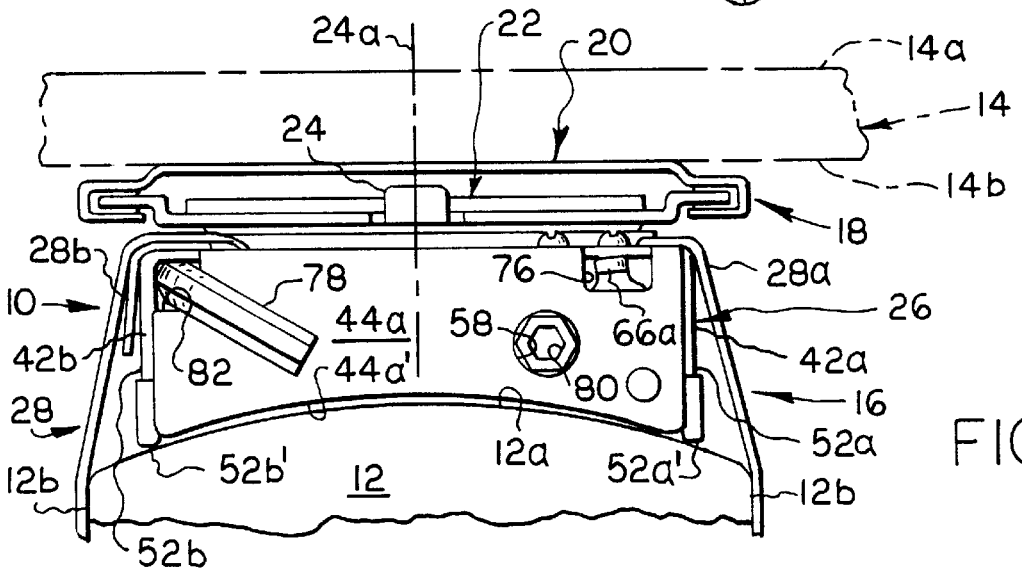
FIG. 2 is a front end elevational view of the holder of FIG. 1 showing it supported by a guide track to depend from a support, such as the top of a desk or workstation.

In the preferred construction, edge portions 42*a* and 42*b* are shaped adjacent their opposite or first and second ends to define downwardly projecting feet 52*a*, 52*b* and 54*a*, 54*b* whose lower edges define pairs of parallel bearing surfaces 52*a'*, 52*b'* and 54*a'*, 54*b'* arranged to engage with an upper or minor side surface 12*a* of component 12, as best shown in FIG. 2. Preferably, the lower free edges 44*a'* and 44*b'* of end portions 44*a* and 44*b* are concave and disposed vertically intermediate bearing surfaces 52*a'*, 52*b'* and 54*a'* and 54*b'* and the lower surface of support plate 40 in order to permit component surface 12*a* to be clamped against such bearing surfaces, even when such component surface is of convex configuration as generally indicated in FIG. 2.

Figure 3:
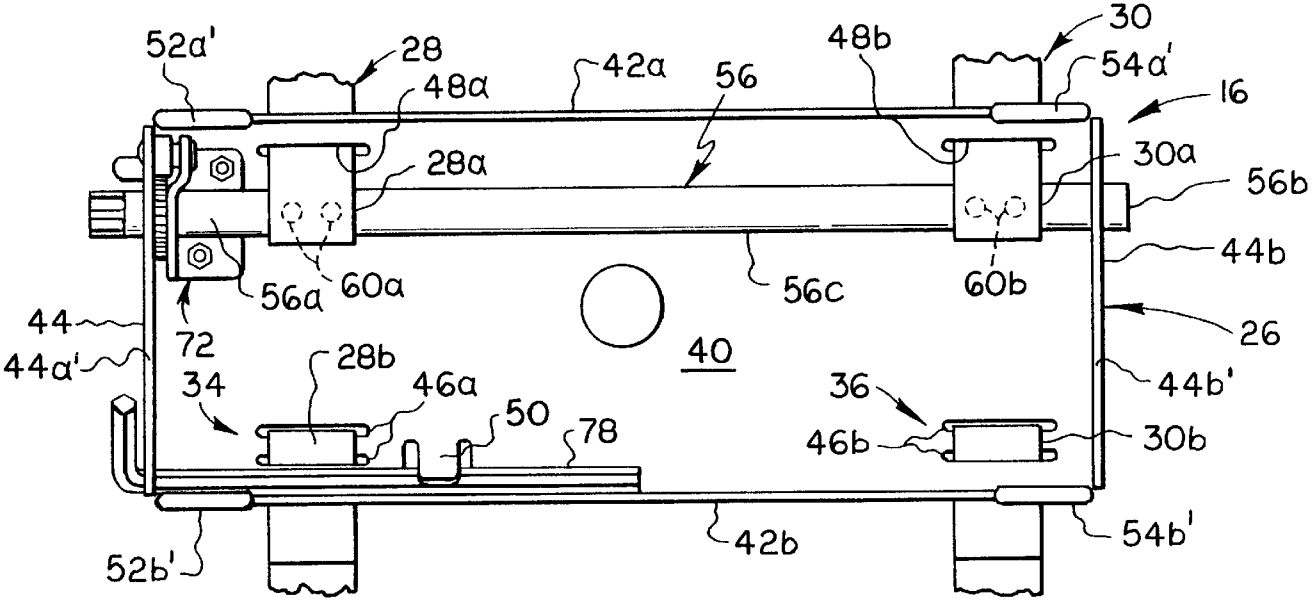
FIG. 3 is a bottom plan view of the holder.

Tension adjustment mechanism 32 is best shown in FIGS. 3–6 as being mounted on support member 26 and as including an elongated tubular rod 56 having opposite ends 56*a* and 56*b* rotatably supported within aligned bore openings formed in end portions 44*a* and 44*b*, wherein only one of such bore openings is shown at 58 in FIG. 2, and a mid-portion 56*c* connected to strap first ends 28*a* and 30*a* by suitable fasteners 60*a* and 60*b* shown only in FIG. 3. Mechanism 32 also includes a toothed wheel 62, which is fixed for rotation with rod 56 by a pin 64 extending radially through the rod a ratchet pawl 66, which is pivotally supported by a bearing pin 68 and arranged to releasably engage with the teeth of toothed wheel 62; and suitable resilient means, such as a coil spring 70, which is mounted on bearing pin 68 with its opposite ends arranged to bear on ratchet pawl 66 and a generally L-shaped bracket 72 fixed to support plate 40. As will be apparent, spring 70 serves to normally retain ratchet pawl 66 in engagement with toothed wheel 62, whereby to permit strap loop shortening rotations of rod 56 in the direction indicated by arrow 74 in FIG. 5, while preventing oppositely directed or strap loop lengthening rotation thereof. Bracket 72 cooperates with first end portion 44*a* to axially locate rod 56, toothed wheel 62 and ratchet pawl 66 and to support opposite ends of bearing pin 68.

Figure 5:
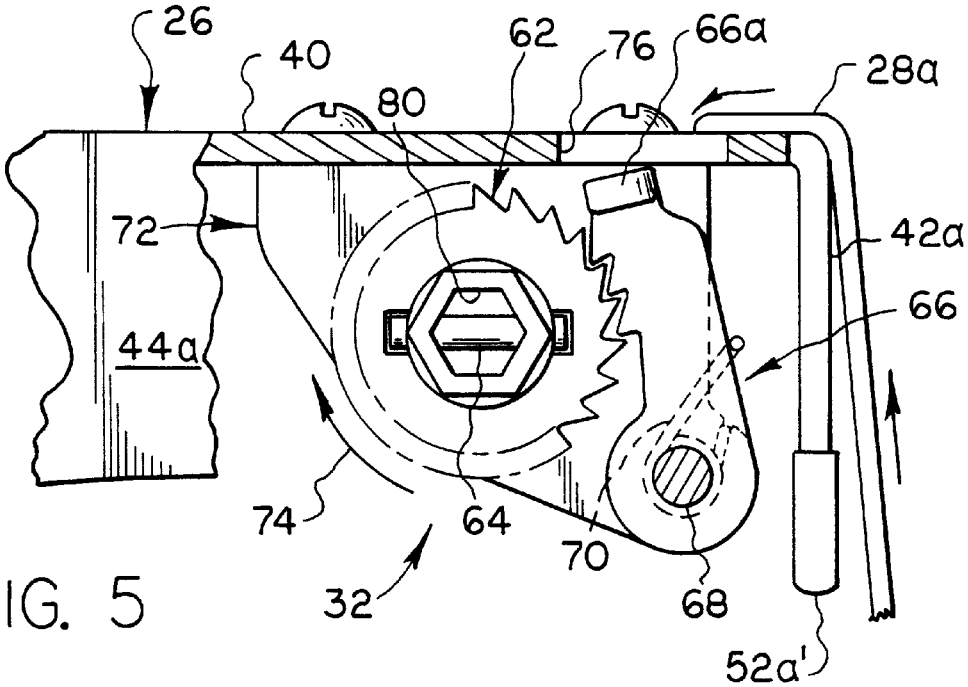
FIG. 5 is an enlarged sectional view taken generally along the line 5—5 in FIG. 4.
Figure 6:
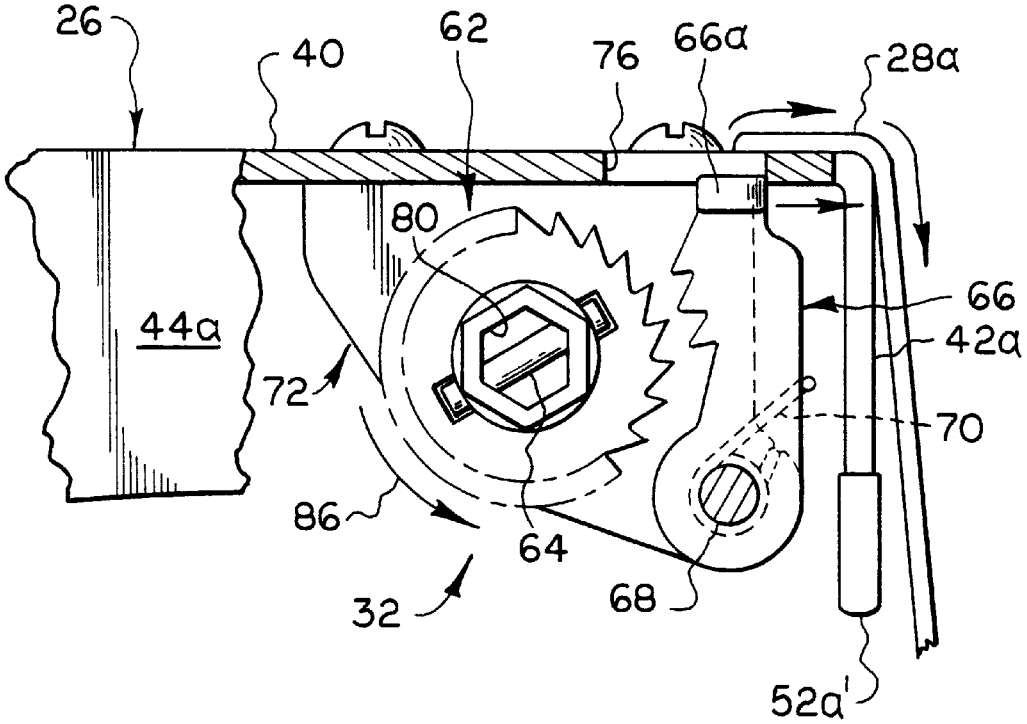
FIG. 6 is a view similar to FIG. 5, but showing the strap tension adjustment mechanism in released condition.

A free end 66*a* of ratchet pawl 66 is arranged to extend forwardly through an access opening 76 formed adjacent the juncture of support plate 40 and first end portion 44*a* in order to permit manually induced movement of ratchet pawl 66 against the bias of spring 70 between its engaged position of FIG. 5 and its released position of FIG. 6.

Figure 4:
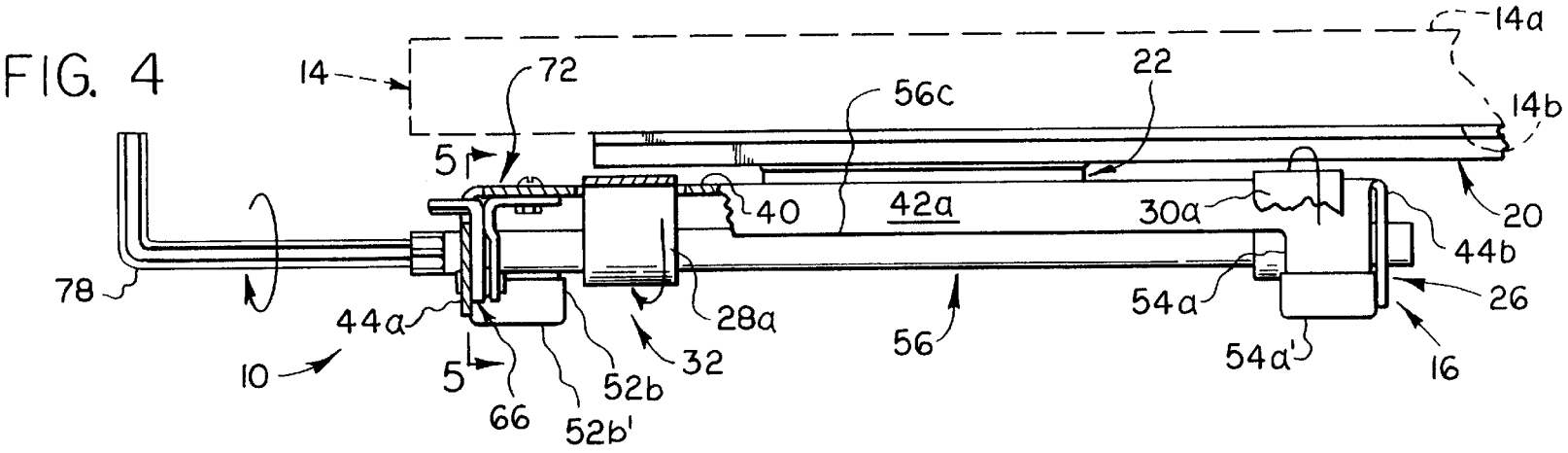
FIG. 4 is a side elevational view of the holder, as viewed from the right side of FIG. 2 with parts broken away to show a strap tension adjustment mechanism.

As will be apparent from viewing FIG. 4, rod 56 may be provided with a suitable operating handle, such as an alien wrench 78 removably received within a suitably shaped drive opening 80 defined by deforming rod end 56*a*. When wrench 78 is not in use, it may be removably stored by inserting same through an access opening 82 formed in first end portion 44*a* into a storage chamber defined by retaining tongue 50 and the lower surface of support plate 40.

In operation, component 12 may be stored beneath support 14 with its major side surfaces 12*b*,12*b* arranged to extend essentially normal to support lower surface 14*b*, by the following procedure. First ratchet pawl 66 is manually released from latching engagement with toothed wheel 62 to free rod 56 for rotation in an unwinding direction, shown by arrow 86 in FIG. 6, in order to allow straps 28 and 30 to be finally unwound from the rod. Strap second ends 28*b* and 30*b* are then threaded through slots 46 and 48, respectively, to define U-shaped loops sized to loosely receive component 12.

Thereafter, the loops are shortened by employing wrench 78 to rotate rod 56 in its strap winding or take-up direction shown by arrow 74 in FIG. 5, until component 12 is lifted sufficiently to place its upper surface 12*a* in clamping engagement with bearing surfaces 52*a'*, 52*b'* and 54*a'*, 54*b'*. Finally, wrench 78 is stored by inserting same through access opening 82.

Whenever it is desired to remove component 12 from its supported position beneath support 14, it is necessary to manually move ratchet pawl 66 into its release position shown in FIG. 6 and then unwind or loosen straps 28 and 30 sufficiently to permit withdrawal of the component from within the loops.

A first alternative embodiment of the present invention will now be described with reference to FIGS. 7–9, wherein its holder and the parts thereof similar to those described above with reference to holder 10 are identified by like one hundred series numerals.

Figures 7, 9:
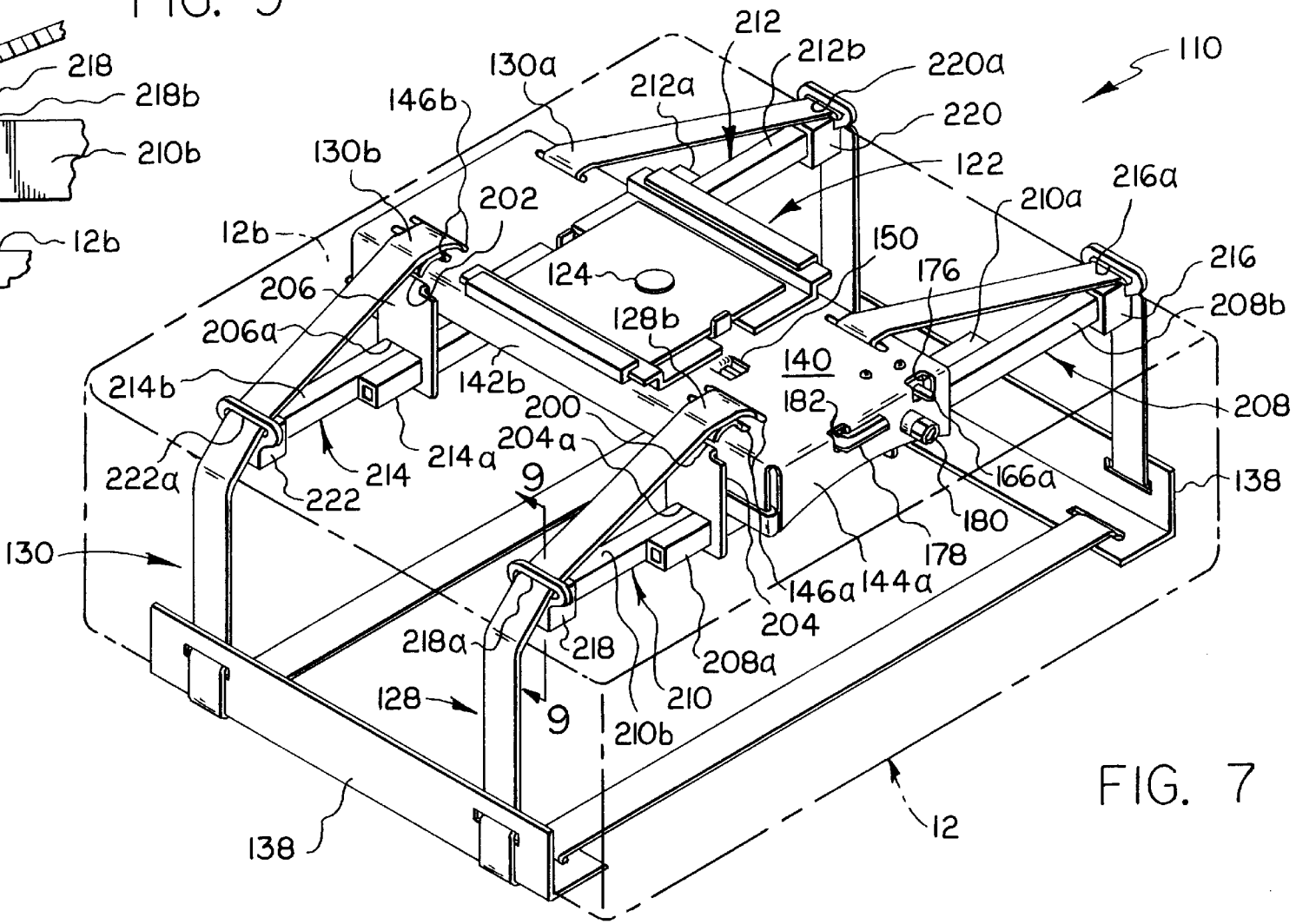
FIG. 7 prospective view of a holder formed in accordance with a first alternative embodiment of the present invention.
FIG. 9 is a sectional view taken generally along the line 9—9 in FIG. 7.
Figure 8:
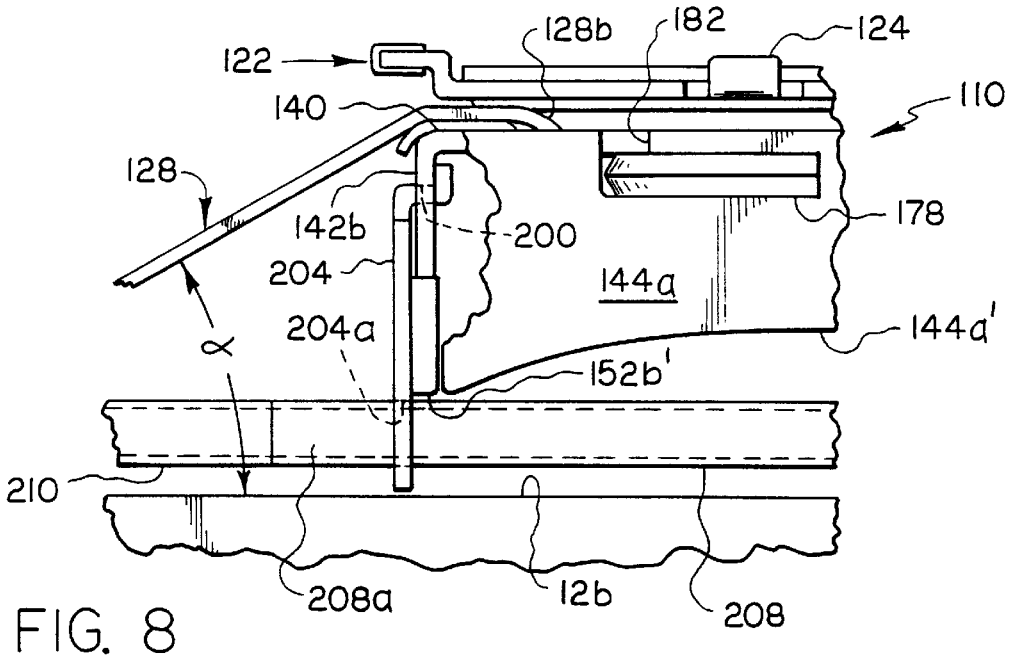
FIG. 8 is fragmentary front elevational view of the holder of FIG. 7.

More specifically, holder 110 is intended for use in mounting component 12 such that its major surfaces 12*b* are horizontally disposed, as best shown in FIGS. 7 and 8. Holder 110 differs from holder 10 in that its clamping means additionally includes a pair of mounting openings formed in each of the depending edge portions of support plate 140, which are shown in part only in FIG. 7 for the case of mounting openings 200 and 202 formed in edge portion 142*b*; mounting clips removably inserted one in each of the mounting openings, as also shown in part only in FIG. 7 for the case of mounting clips 204 and 206 to depend parallel to the edge portions on which same are mounted; two pairs of tubes 208, 210 and 212, 214; and two pairs of strap guiding end caps 216, 218 and 220, 222. Each of the mounting clips is formed with a slide mounting opening, shown only for the case of slide mounting openings 204*a* and 206*a* of clips 204 and 206, which are adapted to removably, slidably support relatively adjacent end portions 208*a,* 210*a* and 212*a,* 214*a* of the tubes 208, 210 and 212, 214 with the relatively remote end portions 208*b,* 210*b* and 212*b,* 214*b* of such tubes serving to mount end caps 216, 218 and 220, 222, respectively. End caps 216 and 218 each define guide slots 216*a* and 218*a* for slidably receiving strap 128; and end caps 220 and 222 define guide slots 220*a* and 222*a* for slidably receiving strap 130. Further, the end caps are each formed with a mounting recess for receiving an associated remote end portion of a tube on which same is mounted and a downwardly facing bearing surface for engaging component upper major side surface 12*b;* only one of such mounting recesses and such bearing surfaces being shown at 218*b* and 218*c,* respectively, for the case of end cap 218 in FIG. 9.

By viewing FIG. 8, it will be understood that the clamping means of the first alternative form of the invention, in which the bearing surfaces of the guide clips engage with the upper major surface 12*b* of component, serves to space the upper surface of support plate 140 through a greater distance from such major surface than would be the case, if such major surface were engaged by the bearing surfaces of the preferred form of the invention including surface 152*b'*. This increase in distance serves to increase the angle a defined by the straps and surface 12*b,* so as to maximize the component of the tension force acting on the straps, which is available for clamping component 12 relative to holder 110, while minimizing the component of the tension force tending to crush component 12, in a direction extending parallel to major surface 12*b*. The valve of angle a may, for example, be increased by increasing the vertical dimension of the mounting clips, as measured between the upper mounting ends of such clips and their slide mounting openings, as viewed in FIG. 8.

In operation of the first alternative form of the invention, a user is required to insert the mounting clips into their associated mounting openings; insert the tubes into their associated slide mounting openings of the mounting clips; insert the remote end portions of the tubes into their associated end clips; thread straps 128 and 130 through guide slots 216*a* and 220*a,* spacer braces 138 and 138, guide slots 218*a* and 222*a,* and slots 146*a,* 146*a* and 146*b,* 146*b,* whereby to form loops of a size sufficient to receive component 12. Wrench 178 is then inserted into drive opening 180 and operated as required to shorten the loops and draw component 12 upwardly to clamp same in a mounted position relative to holder 110.

A second alternative embodiment of the present invention will now be described with reference to FIG. 10, wherein its holder and the parts thereof similar to those described above with reference to holder 10 are identified by like three hundred series numerals.

Figure 10:
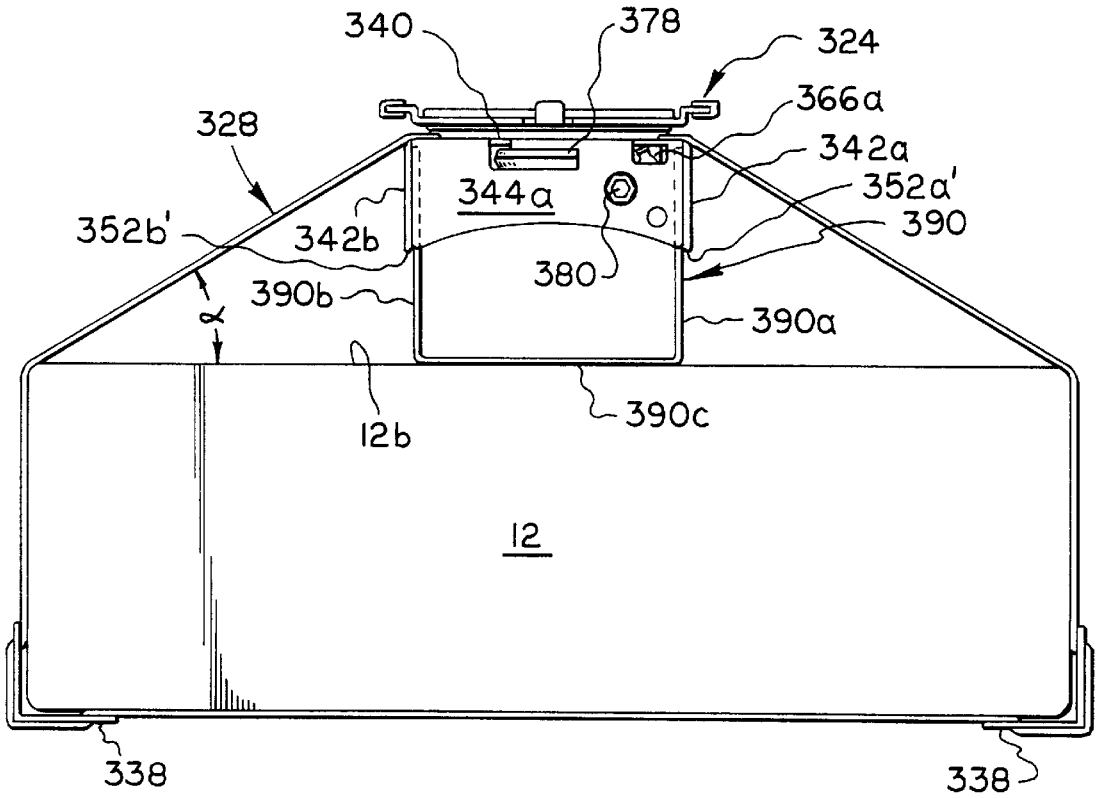
FIG. 10 is a front elevational view of a holder formed in accordance with a second alternative embodiment of the present invention.

More specifically, holder 310 is intended for use in mounting a component 12 such that its major surfaces 12*b* are horizontally disposed, as shown in FIG. 10. Holder 310 differs from holder 10 in that its clamping means additionally includes a single U-shaped spacer unit 390, which includes a pair of side panels 390*a* and 390*b,* which have lower edges joined to parallel side edges of a bottom panel 390*c* and upper edges, not shown, arranged to removably bear or abut against the lower surface of support plate 340. If desired, one or both open ends of spacer unit 390 may be bridged by suitable end panels, not shown, if required for aesthetic and/or unit rigidifying purposes. Spacer unit 390 performs the same function as the clamping means described with reference to FIGS. 7–9, namely, that of serving to maximize the angle a formed by the straps and the upper major surface 12*b* of the component to be supported by the holder.

In operation, a user would first insert spacer unit 390 into the support member intermediate side edge portions 342*a* and 342*b* to position same in abutting engagement with the lower surface of support plate 340. Thereafter, the user will follow the procedure described with reference to holder 10.

What is claimed is:

1. A mechanism for suspending a component below a support, said mechanism comprising:

a mounting means adapted to be attached to said support; and component clamping means, said mounting means suspending said clamping means below said support, said clamping means including a support member coupled to said mounting means, a pair of straps each having first and second ends, tension adjustment means mounted on said support member and connected to said first ends of said straps, and attaching means for attaching said second ends to said support member and cooperating with said tension adjustment means to suspend said straps by said first and second ends thereof to form U-shaped loops arranged beneath said support member for receiving said component therewithin, and said tension adjustment means being manually operable to releasably shorten the lengths of said loops for clamping said component relative to said support member.

2. The mechanism according to claim 1, wherein said support member defines two pairs of bearing surfaces arranged to be releasably clamped against by said component.

3. The mechanism according to claim 2, wherein said bearing surfaces extend transversely of said loops with first bearing surfaces of each said pair being aligned and disposed relatively adjacent said attaching means and second bearing surfaces of each said pair being aligned and disposed relatively adjacent said tension adjustment means.

4. The mechanism according to claim 1, wherein said support member includes support plate coupled to said mounting means to assume a horizontally disposed position when said mounting means is attached to said support, said support plate having depending first and second parallel edge positions each defining adjacent first and second ends thereof a pair of aligned bearing surfaces extending transversely of said loops and arranged for clamping engagement with said component.

5. The mechanism according to claim 4, wherein said support plate has depending end portions extending normal to said edge portions, said end portions cooperating to mount said tension adjustment means and having concave free edges arranged intermediate said bearing surfaces and said support plate.

6. The mechanism according to claim 1, wherein said support member includes a support plate having depending first and second edge portions and depending first and second parallel end portions disposed normal to said edge portions, said bearing surfaces extending below said end portions, and said tension adjustment means is carried by said end portions.

7. The mechanism according to claim 6, wherein said tension adjustment means includes an elongated rod having opposite ends rotatably supported by said end portions and a mid-portion connected to said first ends of said straps, a toothed wheel fixed for rotation with said rod, a ratchet pawl pivotally mounted on said support member and arranged to releasably engage said toothed wheel, resilient means tending to releasably bias said ratchet pawl into engagement with said toothed wheel for normally permitting manual rotation of said rod in a first direction to shorten said loops, said pawl being manually movable against said bias to release said pawl from engagement with said toothed wheel for allowing manually induced lengthening of said loops.

8. The mechanism according to claim 7, wherein said attaching means is carried by said support plate.

9. The mechanism according to claim 8, wherein said attachment means is defined by pairs of parallel slots formed in said support plate for releasably, threadably receiving said second ends of said straps.

10. The mechanism according to claim 9, wherein said support plate has a pair of through openings for freely receiving said straps extending from said mid-portion of said rod.

11. The mechanism according to claim 10, wherein said end portions have concave free edges arranged intermediate said bearing surfaces and said support plate.

12. The mechanism according to claim 1, wherein said support member includes a support plate having a pair of depending first and second end portions; and said tension adjustment means includes an elongated rod having opposite ends rotatably supported by said end portions and a mid-portion connected to said first ends of said straps, a toothed wheel fixed for rotation with said rod, a ratchet pawl pivotally mounted on said support member and arranged to releasably engage said toothed wheel, resilient means for providing a bias tending to releasably maintain said ratchet pawl in engagement with said toothed wheel for normally permitting manual rotation of said rod in a first direction to shorten said loops, said pawl being manually movable against said bias to release said pawl from engagement with said toothed wheel for allowing manually induced lengthening of said loops.

13. The mechanism according to claim 12, wherein said support plate has depending side edge portions disposed normal to said end portions, and said clamping means includes mounting openings defined by each of said side edge portions and mounting clips removably supported one within each of said mounting openings to depend normal to said support plate and parallel to said side edge portions, each of said mounting clips being formed with a slide mounting opening two pairs of extension tubes having remote end portions and adjacent end portions, said adjacent end portions of said extension tubes being removably slidably mounted within an aligned pair of slide mounting openings to position said remote end portions in an outwardly spaced relationship relative to said side edge portions of said support plate, and end guides mounted one on each of said remote end portions for sliding engagement with said straps.

14. The mechanism according to claim 1, wherein said support member has depending side edge portions, and said clamping means includes mounting openings defined by each of said side edge portions and mounting clips removably supported one within each of said mounting openings to depend normal to said support plate and parallel to said side edge portions, each of said mounting clips being formed with a slide mounting opening, two pairs of extension tubes having remote end portions and adjacent end portions, said adjacent end portions of said extension tubes being removably slidably mounted within an aligned pair of slide mounting openings to position said remote end portions in an outwardly spaced relationship relative to said side edge portions of said support plate, and end guides mounted one on each of said remote end portions for sliding engagement with said straps.

15. The mechanism according to claim 1, wherein said support member defines bearing surface arranged to face downwardly relative thereto for engagement by said component upon said clamping thereof relative to said support member, and said clamping means additionally includes a spacer unit removably mounted on said support member and defining a further bearing surface, said further bearing surface being arranged to face downwardly and be disposed relatively below said bearing surface when said spacer unit is mounted on said support member, whereby said component may be clamped against said further bearing surface when said spacer unit is mounted on said support member and the lengths of said loops are shortened.

16. The mechanism according to claim 1, wherein said support member includes a generally horizontally disposed support plate having downwardly extending parallel edge portions, and said clamping means additionally includes a spacer unit of U-shaped configuration defined by a pair of side panels upstanding from a lower panel defining a bearing surface, said side panels being removably insertable between said edge portions for underengagement with said support plate.

* * * * *

UNITED STATES PATENT AND TRADEMARK OFFICE

CERTIFICATE OF CORRECTION

PATENT NO. : 6,098,944
DATED : August 8, 2000
INVENTOR(S) : Donald R. Pangborn et al.

It is certified that error appears in the above-identified patent and that said Letters Patent is hereby corrected as shown below:

Column 2,
Line 35, replace "FIG. 8 is a fragmentary front view" with -- FIG. 8 is a fragmentary front view --

Column 3,
Line 11, replace "the straps a s U-shaped loops" with -- the straps as U-shaped loops --
Line 34, replace "slot s th rough" with -- slots through --

Column 4,
Line 15, replace "alien wrench" with -- allen wrench --
Line 29, replace "finally unwound" with -- fully unwound --

Column 5,
Lines 23 and 28, replace "angle a" with -- angle --

Signed and Sealed this

Fourth Day of February, 2003

JAMES E. ROGAN
*Director of the United States Patent and Trademark Office*